US009287622B2

(12) United States Patent
Huang et al.

(10) Patent No.: US 9,287,622 B2
(45) Date of Patent: Mar. 15, 2016

(54) TUNABLE LONG TERM EVOLUTION ANTENNA

(71) Applicant: AUDEN TECHNO CORP., Taoyuan County (TW)

(72) Inventors: Yu-Tsung Huang, Kaohsiung (TW); Yen-Chao Li, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 135 days.

(21) Appl. No.: 14/276,931

(22) Filed: May 13, 2014

(65) Prior Publication Data

US 2015/0333399 A1 Nov. 19, 2015

(51) Int. Cl.

| | |
|---|---|
| ***H01Q 1/24*** | (2006.01) |
| ***H01Q 5/307*** | (2015.01) |
| ***H01Q 5/10*** | (2015.01) |
| ***H01Q 5/30*** | (2015.01) |
| ***H01Q 5/378*** | (2015.01) |

(52) U.S. Cl.

CPC ..... *H01Q 5/307* (2015.01); *H01Q 5/10* (2015.01); *H01Q 5/30* (2015.01); *H01Q 5/378* (2015.01)

(58) Field of Classification Search

CPC ..... H01Q 5/30; H01Q 5/307; H01Q 5/378; H01Q 5/10; H01Q 1/243

USPC ..... 343/702

See application file for complete search history.

(56) References Cited

U.S. PATENT DOCUMENTS

| | | | | |
|---|---|---|---|---|
| 6,950,065 | B2 * | 9/2005 | Ying | H01Q 1/243 343/700 MS |
| 8,847,828 | B1 * | 9/2014 | Lee | H01Q 5/30 343/700 MS |
| 9,002,262 | B1 * | 4/2015 | Kuo | H01Q 1/50 343/702 |
| 2012/0050119 | A1 * | 3/2012 | Wang | H01Q 5/364 343/728 |
| 2013/0120200 | A1 * | 5/2013 | Desclos | H01Q 25/04 343/745 |

* cited by examiner

*Primary Examiner* — Hoang V Nguyen

(74) *Attorney, Agent, or Firm* — Li & Cai Intellectual Property (USA) Office

(57) ABSTRACT

A tunable long term evolution antenna comprises a feeding portion, a grounding portion, a first radiation portion, a second radiation portion and a coupling radiation portion. The shape of the first radiation portion is a strip. Two terminals of the strip respectively are a first terminal and a second terminal. The first terminal is connected to the feeding portion and the grounding portion. The second radiation portion is connected to the grounding portion and the first terminal of the first radiation portion. The coupling radiation portion has a switching terminal coupled to a switch, a low frequency coupling portion and a high frequency coupling portion. The switch controls the switching terminal to be coupled to the ground or floating. The tunable long term evolution antenna operates in a LTE technology mode or a 3G mode depending on the switching terminal is coupled to the ground floating.

10 Claims, 6 Drawing Sheets

TUNABLE LONG TERM EVOLUTION ANTENNA

BACKGROUND OF THE INVENTION

1. Field of the Invention

The instant disclosure relates to an antenna; in particular, to a tunable long term evolution antenna.

2. Description of Related Art

The mobile communication devices such as smart phones or tablet PCs have been common in daily life of people. Especially, the third-generation (3G) mobile communication system has been gradually replaced by the fourth-generation (4G) mobile communication system. The insufficient data transfer rate of the 3G mobile communication system could be overcome by the 4G mobile communication system, wherein the long term evolution (LTE) technology is an important standard of the 4G mobile communication system, and most telecommunications providers of many countries are planning to utilize the LTE technology for the 4G mobile communication system.

As for the mobile communication device of the terminal of the users, in order to make use of many bands in the mobile communication system, the manufacturers or research and development engineers of the antenna may apply a variety of designs for the antenna in the mobile communication device to meet a plurality of communication specifications. However, the antenna should be designed to comply with the specifications while applying to the 3G mobile communication system and the specifications of the 4G mobile communication system at the same time, thus it may cause increasing the complexity of antenna design.

SUMMARY OF THE INVENTION

The object of the instant disclosure is to provide a tunable long term evolution antenna In order to achieve the aforementioned objects, according to an embodiment of the instant disclosure, a tunable long term evolution antenna is offered. The tunable long term evolution antenna comprises a feeding portion, a grounding portion, a first radiation portion, a second radiation portion and a coupling radiation portion. The feeding portion is coupled to a radio frequency circuit, and the feeding portion has at least one bending. The grounding portion is coupled to a ground. The shape of the first radiation portion is a strip. Two terminals of the strip respectively are a first terminal and a second terminal. The first terminal is connected to the feeding portion and the grounding portion. The second radiation portion is connected to the grounding portion and the first terminal of the first radiation portion. The coupling radiation portion has a switching terminal, a low frequency coupling portion and a high frequency coupling portion. The switching terminal is connected between the low frequency coupling portion and the high frequency coupling portion. The switch terminal is coupled to a switch. The switch is connected to the ground. The switch is for determining whether the switching terminal is coupled to the ground or floating. The low frequency coupling portion and the first radiation portion are disposed in parallel. The lower frequency coupling portion is near to the second terminal of the first radiation portion by a first spacing. The high frequency coupling portion has at least a branch, and the branch is near to the second terminal of the first radiation portion by a second spacing. The feeding portion, the grounding portion, the first radiation portion, and the coupling radiation portion are disposed on a nonconductive substrate. The tunable long term evolution antenna operates in a long term evolution (LTE) technology mode when the switching terminal of the coupling radiation portion is coupled to the ground through the switch. The tunable long term evolution antenna operates in a third-generation (3G) mode when the switching terminal of the coupling radiation portion is floating.

In summary, the provided tunable long term evolution antenna makes use of setting whether the coupling radiation portion is coupled to the ground for adjusting the operation mode of the tunable long term evolution antenna. The tunable long term evolution antenna has a simple structure, and the switching of the operation mode is easy.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
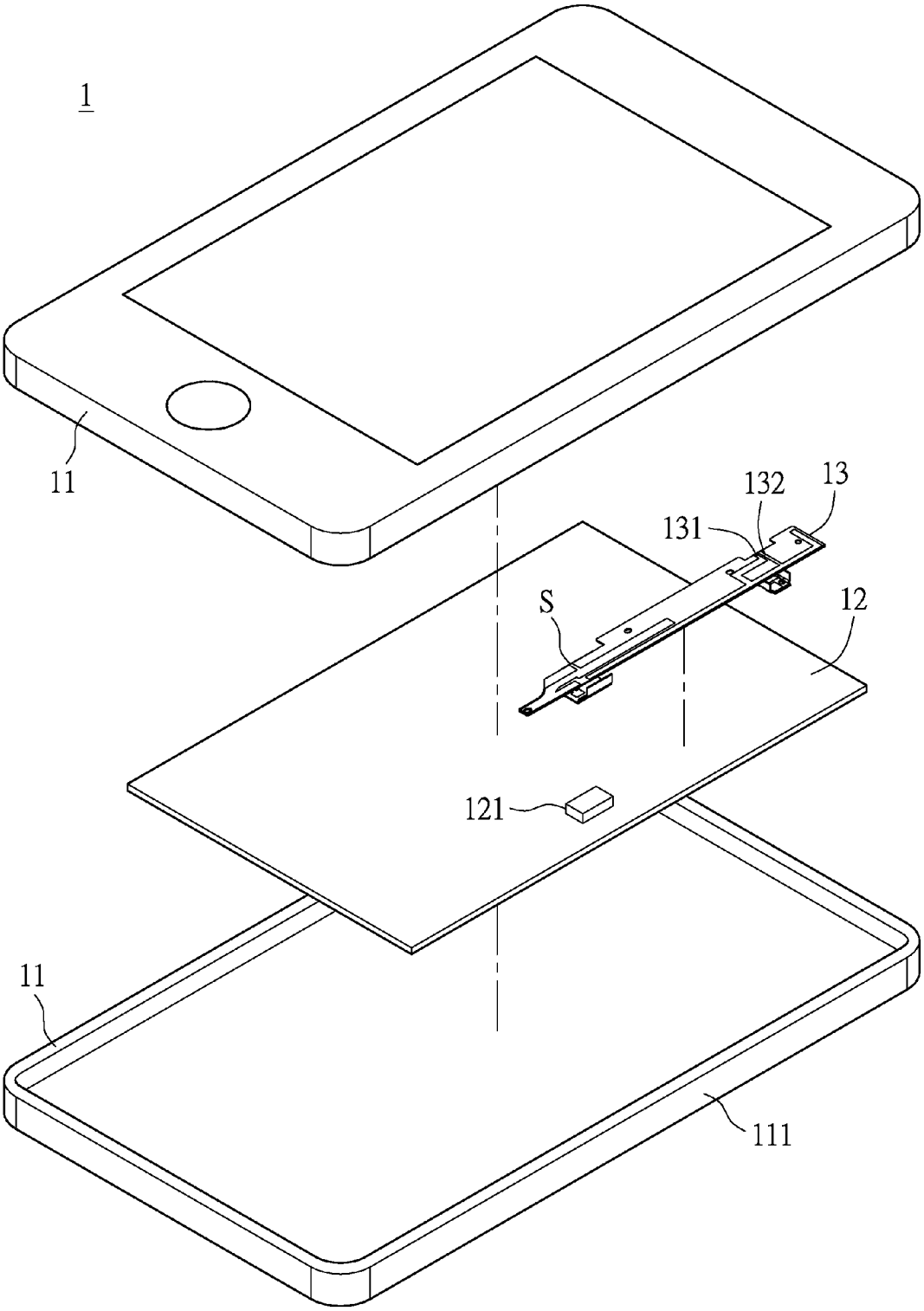
FIG. 1 shows a schematic diagram of a mobile communication according to an embodiment of the instant disclosure.

Please refer to FIG. 1 showing a schematic diagram of a mobile communication according to an embodiment of the instant disclosure. A mobile communication device 1 comprises a casing 11, a circuit board 12 and a tunable long term evolution antenna 13. The tunable long term evolution antenna is installed near a long side 111 of the bar-type mobile communication device (e.g. a smart phone). In general, the long side 111 of the bar-type communication device is held by the user hand when the user operates the bar-type communication device 1. In this embodiment, the tunable long term evolution antenna 13 is designed as located along with the long side of the bar-type communication device 1. The tunable long term evolution antenna 13 has a feeding portion 131, a grounding portion 132 and a switching terminal S. The feeding portion 131, the grounding portion 132 and the switching terminal S is connected to the circuit of the circuit board 12. The feeding portion 131 is coupled to a radio frequency circuit (not shown in the figure). The grounding portion 132 is coupled to the ground of the circuit board 12. The switching terminal S is coupled to a switch 121 on the circuit board 12.

Figure 2A:
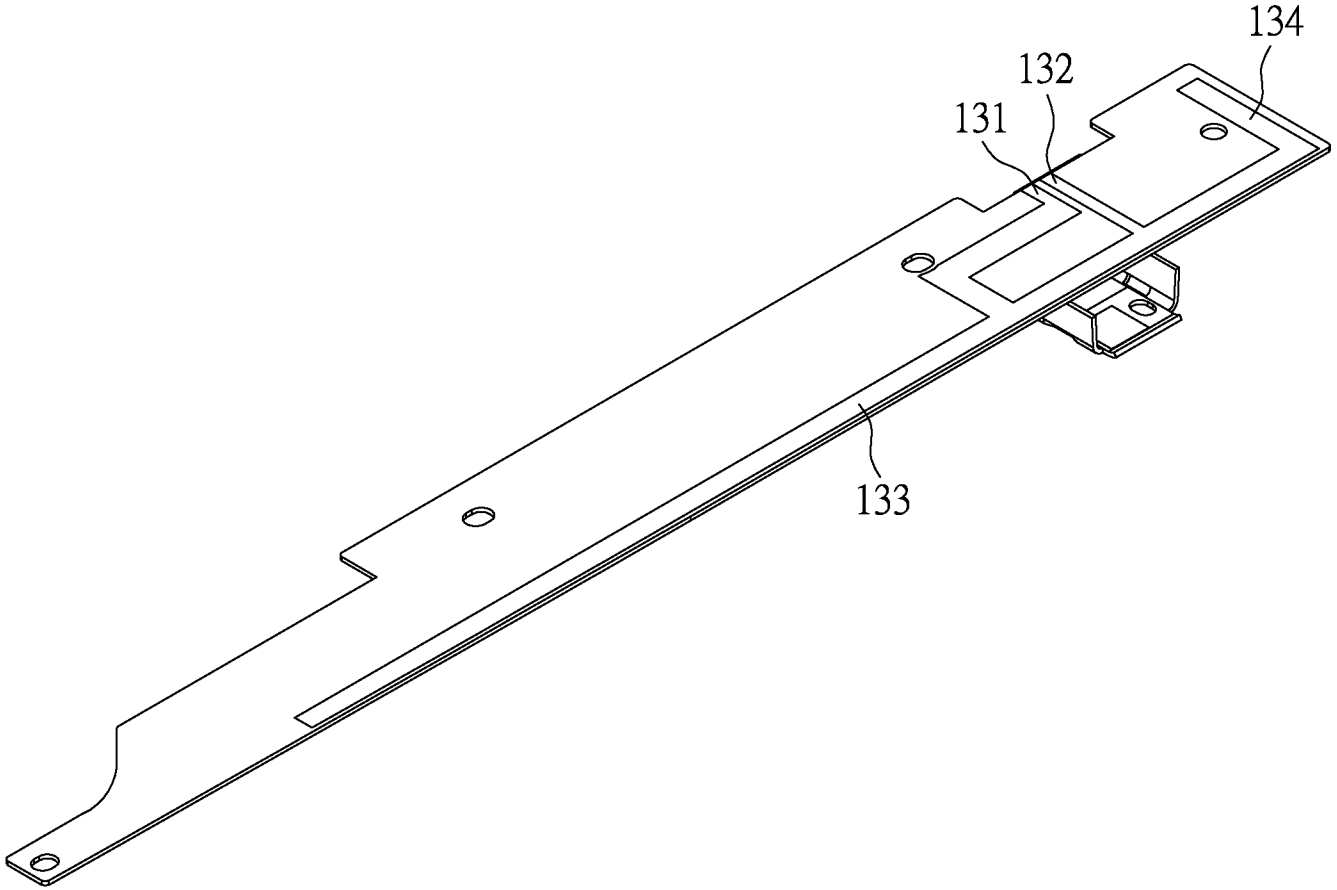
FIG. 2A shows a schematic diagram of a Planar Inverted-F Antenna (PIFA) according to an embodiment of the instant disclosure.

Please refer to FIG. 2A showing a schematic diagram of a Planar Inverted-F Antenna (PIFA) according to an embodiment of the instant disclosure. The planar inverted-F antenna comprises a feeding portion 131, a grounding portion 132, a first radiation portion 133 and a second radiation portion 134. Due to shorting between the grounding portion 132 and the system ground (not shown in the figure), the length of the first radiation portion 133 and the second radiation portion 134 could be reduced, thus the space occupied by the antenna could be saved. The length of the first radiation portion 133 is longer than the length of the second radiation portion 134. As shown in FIG. 2A, the first radiation portion 133 and the second radiation portion 134 are extending in opposite directions. Because the length of the first radiation portion 133 is longer than the second length of the second radiation portion 134, the first radiation portion 133 could excite a resonant mode with relatively lower frequency, and the second radiation portion 134 could excite another resonant mode with relatively higher frequency. The planar inverted-F antenna may be made by a metal plate, a copper foil, an aluminum foil, a printed circuit board, a flexible circuit board or other conductive elements.

Figure 2B:
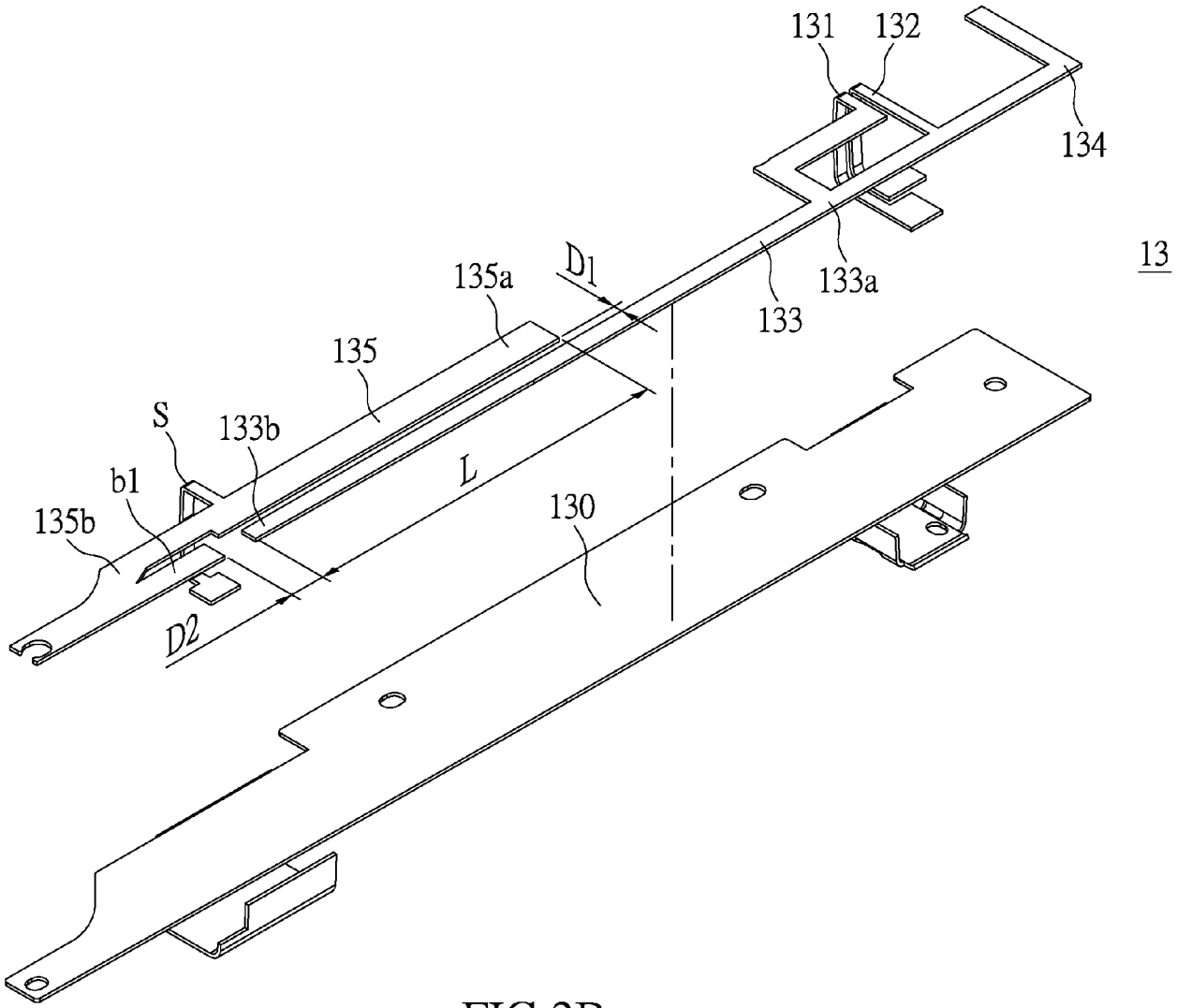
FIG. 2B shows a schematic diagram of a tunable long term evolution antenna according to an embodiment of the instant disclosure.

Please refer to FIG. 2A in conjunction with FIG. 2B, FIG. 2B shows a schematic diagram of a tunable long term evolution antenna according to an embodiment of the instant disclosure. The tunable long term evolution antenna 13 is improved base on the planar inverted-F antenna shown in FIG. 2A, and a coupling radiation portion 135 is added. Specifically, the tunable long term evolution antenna 13 comprises a feeding portion 131, a grounding portion 132, a first radiation portion 133, a second radiation portion 134 and a coupling radiation portion 135. The feeding portion 131, the grounding portion 132, the first radiation portion 133, the second radiation portion 134 and the coupling radiation portion 135 may be a copper plate or a copper foil for example, but the instant disclosure is not so restricted. The feeding portion 131, the grounding portion 132, the first radiation portion 133, the second radiation portion 134 and the coupling radiation portion 135 may be any conductive elements. The feeding portion 131, the grounding portion 132, the first radiation portion 133, the second radiation portion 134 and the coupling radiation portion 135 are supported by a nonconductive substrate 130. In this embodiment, in order to simplify the design, the feeding portion 131, the grounding portion 132, the first radiation portion 133, the second radiation portion 134 and the coupling radiation portion 135 are disposed on the same surface of the nonconductive substrate 130, but the instant disclosure is not so restricted. The grounding portion 132, the first radiation portion 133, the second radiation portion 134 and the coupling radiation portion 135 may be disposed on different surface of the nonconductive substrate 130.

The feeding portion 131 is coupled to a radio frequency (RF) circuit, and the feeding portion 131 has at least one bending. The grounding portion 132 is coupled to the ground. The shape of the first radiation portion 131 is a strip. Two terminals of the strip respectively are a first terminal 133*a* and a second terminal 133*b*. The first terminal 133*a* is connected to the feeding portion 131 and the grounding portion 132. The second radiation portion 134 is connected to the grounding portion 132 and the first terminal 133*a* of the first radiation portion 133. In this embodiment, the second radiation portion 134 is extending toward the opposite direction of the first radiation portion 133, and the second radiation portion 134 has at least one bending, for example the second radiation portion 134 shown in FIG. 2B has a right angle bending. The second radiation portion 134 excites a resonant mode comprising the band of 2.4 GHz in Industrial Scientific Medical (ISM) band.

The coupling radiation portion 135 has a switching terminal S, a low frequency coupling portion 135*a* and a high frequency coupling portion 135*b*. The switching terminal S is connected between the low frequency coupling portion 135*a* and the high frequency coupling portion 135*b*. The switch terminal S is coupled to a switch 121. The switch 121 is connected to the ground of the circuit board 12. The switch 121 is for determining whether the switching terminal S is coupled to the ground or floating, in which the switch 121 would be described later. The low frequency coupling portion 135*a* and the first radiation portion 133 are disposed in parallel, and the lower frequency coupling portion 135*a* is near to the second terminal 133*b* of the first radiation portion 133 by a first spacing D1. The coupling length L and the first spacing D1 between the parallel lower frequency coupling portion 135*a* and the first radiation portion 133 may be can be determined arbitrarily as needed. For example, the coupling length L may be dozens of millimeters, and the first spacing D1 may ranges from 1 millimeter to 5 millimeters, but the instant disclosure is not restricted thereto.

The high frequency coupling portion 135*b* has at least a branch b1, and the branch b1 is near to the second terminal 133*b* of the first radiation portion 133 by a second spacing D2. In this embodiment, the second spacing D2 ranges from 1 millimeter to 3 millimeters, but the instant disclosure is not so restricted.

The tunable long term evolution antenna 13 operates in a long term evolution (LTE) technology mode when the switching terminal S of the coupling radiation portion 135 is coupled to the ground through the switch 121. The tunable long term evolution antenna 13 operates in a third-generation (3G) mode when the switching terminal S of the coupling radiation portion 135 is floating.

Figure 3:
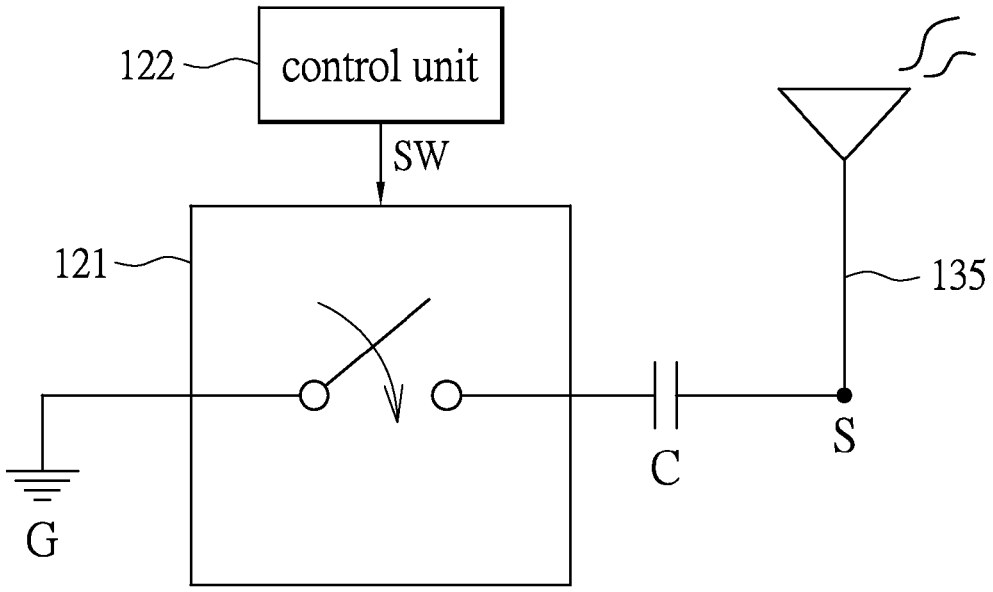
FIG. 3 shows a circuit diagram of a coupling radiation portion according to an embodiment of the instant disclosure.

Please refer to FIG. 2B in conjunction of FIG. 3, FIG. 3 shows a circuit diagram of a coupling radiation portion according to an embodiment of the instant disclosure. The switching terminal S of the coupling portion 135 is coupled to the switch 121. As shown in FIG. 3 the switching terminal S of the coupling radiation portion 135 is coupled to the switch 121 through a capacitor C, but the coupling between the switching terminal S of the first coupling radiation portion 135 and the switch 121 is not so restricted. For example, the switching terminal S of the coupling radiation portion 135 may be directly connected to the switch 121. The switch 121 may be a manual switch, such as a dip switch, a slide switch, a rocker switch or a button switch. The user could use his (or her) finger to control the switch 121 in order to change the operation mode of the tunable long term evolution antenna 13. Alternatively, the switch 121 may be an electronic switch, as shown in FIG. 3, the switch 121 is connected the control unit 122 of the circuit board 12, in which the control unit 122 could generate a control signal SW to control the switch 121. The switch 121 may controls the switching terminal S of the coupling radiation portion 135 to be coupled to the ground G or floating.

Figure 4:
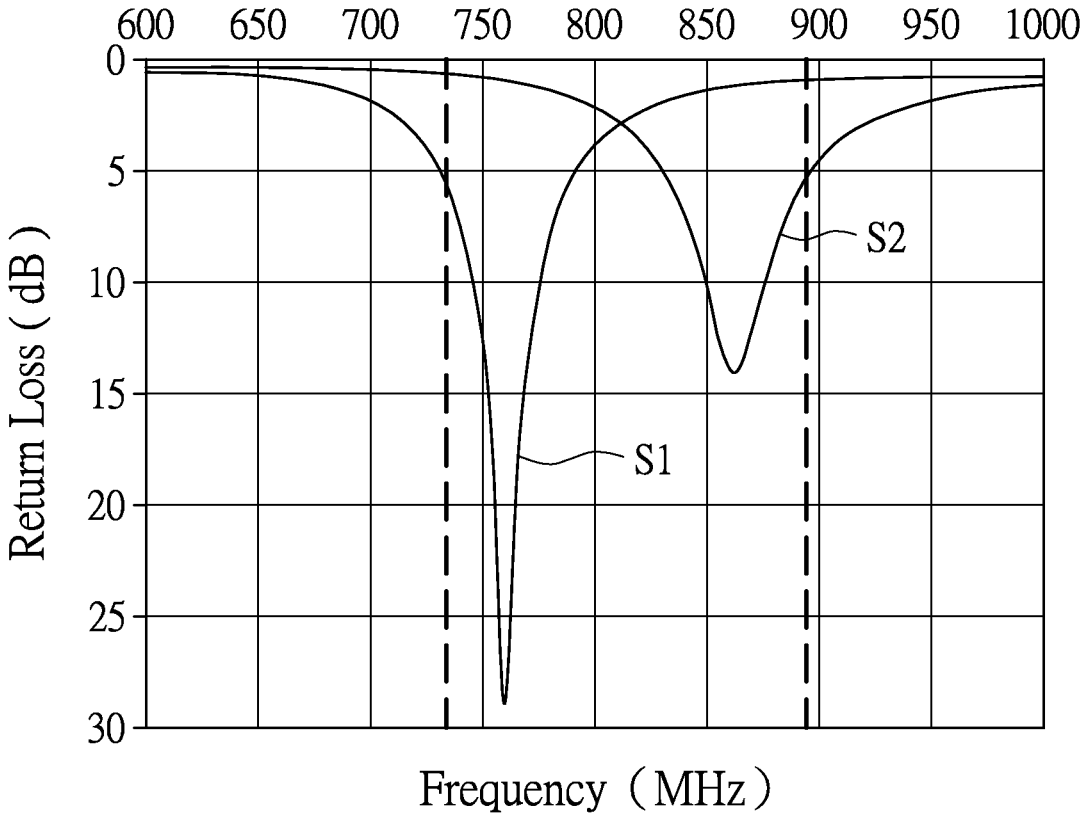
FIG. 4 shows a diagram of the return loss in a low frequency range of a tunable long term evolution antenna according to an embodiment of the instant disclosure.

Specifically, please refer to FIG. 4 showing a diagram of the return loss in a low frequency range of a tunable long term evolution antenna according to an embodiment of the instant disclosure. When the switching terminal S of the coupling radiation portion 135 is coupled to the ground through the switch 121, the first radiation portion 133 and the coupling radiation portion 135 excite a resonant mode covering the LTE Band 17 (UE (User Equipment) transmit 704-716 MHz, receive 734-746 MHz) and the LTE band 13 (UE transmit 777-787 MHz, receive 746-756 MHz) of the long term evolution technology, referring to the curve S1 as shown in FIG. 4. Otherwise, when the switching terminal S of the coupling radiation portion 135 is floating, the first radiation portion 133 and the coupling radiation portion 135 excite a resonant mode covering GSM850 (850 MHz) band and Band 5 of WCDMA (Wideband Code Division Multiple Access), referring to the curve S2 of FIG. 4. In other words, according to the switching of the switch 121, the tunable long term evolution antenna 13 may provide operation frequency ranges from 374 MHz to 894 MHz. For the low frequency band depicted by the curve S1 and the curve S2, the measured antenna efficiency could be from 18% to 30%, thus it can be seen that the practical value of the antenna in this embodiment is quite high.

Figure 5:
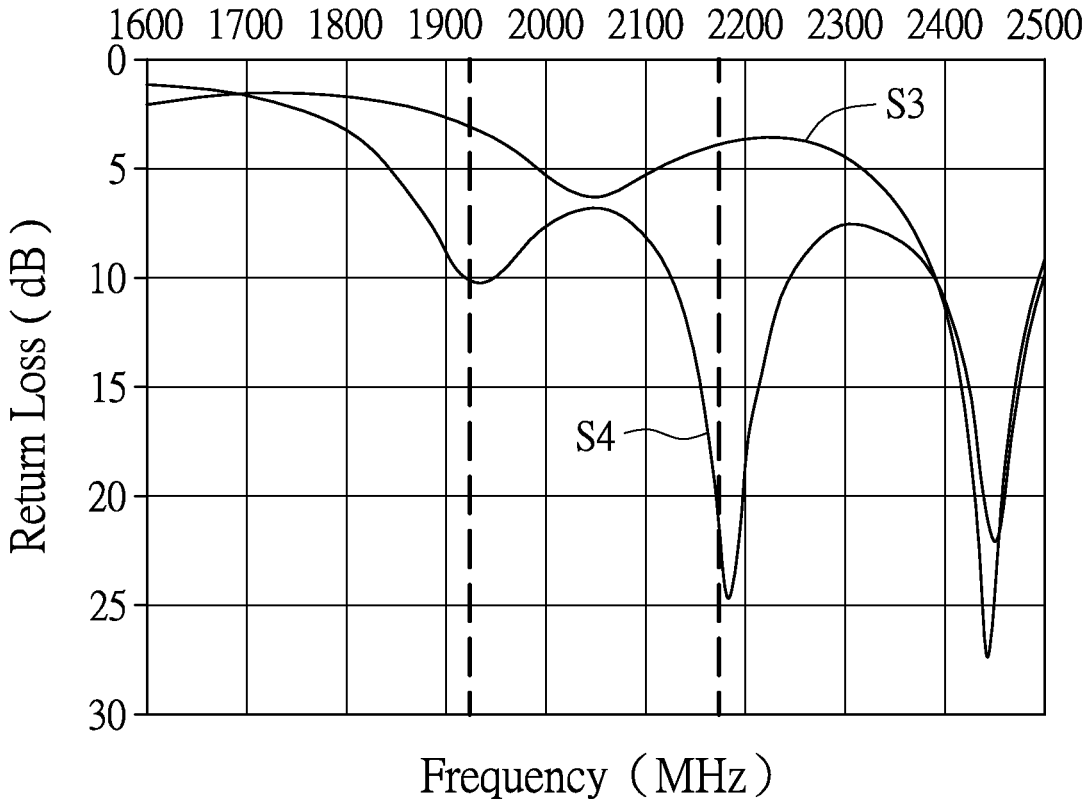
FIG. 5 shows a diagram of the return loss in a high frequency range of a tunable long term evolution antenna according to an embodiment of the instant disclosure.

Please refer to FIG. 5 showing a diagram of the return loss in a high frequency range of a tunable long term evolution antenna according to an embodiment of the instant disclosure. The high frequency coupling portion 135*b* excites the operation bands comprising the Personal Communication Service (PCS) band, Band 1, Band 2 and Band 4 of WCDMA when the switching terminal S of the coupling radiation portion 135 is floating. In other words, when the switching terminal S of the coupling radiation portion 135 is floating, the tunable long term evolution antenna 13 could provide operation frequency ranges from 1930 MHz to 2170 MHz used by the existed third-generation (3G) mobile communication system. Further, as shown in FIG. 5, when the switching terminal S of the coupling radiation portion 135 is floating, the tunable long term evolution antenna 13 could actually provide a wider operation frequency range which is from 1930 MHz to 2500 MHz. Otherwise, as for the condition when switching terminal S of the coupling radiation portion 135 is coupled to the ground through the switch 121, the mobile communication of the LTE technology does not use some bands of the conventional third-generation mobile communication system, thus it does not need a good impedance match for the frequencies from 1930 MHz to 2170 MHz, which is depicted by the curve S3. Additionally, according to the curve S3 and the curve S4, the resonant mode excited by the second radiation portion 134 covering the band of 2.4 GHz in ISM band is not affected by the switching of the switch 121. For the higher frequency band depicted by the curve S3 and the curve S4, the measured antenna efficiency could be from 20% to 30%, thus it can be seen that the practical value of the antenna in this embodiment is quite high.

According to above descriptions, the tunable long term evolution antenna of the embodiment makes use of setting whether the coupling radiation portion is coupled to the ground for adjusting the operation mode of the tunable long term evolution antenna. According to simple operation of the switch, the tunable long term evolution antenna installed near to the long side of the bar-type mobile communication device could be applied to the wireless communication system of LTE technology or the third-generation mobile communication system. The tunable long term evolution antenna has a simple structure, and the switching of the operation mode is easy. The measured antenna efficiency could be from 18% to 30%, thus it can be seen that the practical value of the antenna in this embodiment is quite high.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A tunable long term evolution antenna, comprising:

a feeding portion, coupled to a radio frequency circuit, the feeding portion having at least one bending;

a grounding portion, coupled to a ground;

a first radiation portion, the shape of the first radiation portion is a strip, two terminals of the strip respectively are a first terminal and a second terminal, the first terminal is connected to the feeding portion and the grounding portion;

a second radiation portion, connected to the grounding portion and the first terminal of the first radiation portion; and a coupling radiation portion, having a switching terminal, a low frequency coupling portion and a high frequency coupling portion, the switching terminal connected between the low frequency coupling portion and the high frequency coupling portion, the switch terminal coupled to a switch, the switch connected to the ground, the switch being for determining whether the switching terminal is coupled to the ground or floating, the low frequency coupling portion and the first radiation portion disposed in parallel, the lower frequency coupling portion being near to the second terminal of the first radiation portion by a first spacing, the high frequency coupling portion having at least a branch, the branch being near to the second terminal of the first radiation portion by a second spacing;

wherein the feeding portion, the grounding portion, the first radiation portion, the second radiation portion, and the coupling radiation portion are disposed on a nonconductive substrate, the tunable long term evolution antenna operates in a long term evolution (LTE) technology mode when the switching terminal of the coupling radiation portion is coupled to the ground through the switch, the tunable long term evolution antenna operates in a third-generation (3G) mode when the switching terminal of the coupling radiation portion is floating.

2. The tunable long term evolution antenna according to claim 1, wherein the first radiation portion and the coupling radiation portion excite a resonant mode covering the LTE Band 17 and the LTE band 13 of the long term evolution technology when the switching of the coupling radiation portion is coupled to the ground through the switch.

3. The tunable long term evolution antenna according to claim 1, wherein the first radiation portion and the coupling radiation portion excite a resonant mode covering GSM850 (850 MHz) band and Band 5 of WCDMA when the switching terminal of the coupling radiation portion is floating.

4. The tunable long term evolution antenna according to claim 1, wherein the high frequency coupling portion excites the operation bands comprising the Personal Communication Service (PCS) band, Band 1, Band 2 and Band 4 of WCDMA when the switching terminal of the coupling radiation portion is floating.

5. The tunable long term evolution antenna according to claim 1, wherein the second radiation portion excites the resonant mode comprising the band of 2.4 GHz in Industrial Scientific Medical (ISM) band.

6. The tunable long term evolution antenna according to claim 1, wherein the tunable long term evolution antenna is installed near a long side of a bar-type mobile communication device, and the first radiation portion is parallel to the long side.

7. The tunable long term evolution antenna according to claim 1, wherein the first spacing between the low frequency coupling portion and the first radiation portion ranges from 1 millimeter to 5 millimeters.

8. The tunable long term evolution antenna according to claim 1, wherein the second spacing ranges from 1 millimeter to 3 millimeters.

9. The tunable long term evolution antenna according to claim 1, wherein the switch is a dip switch, a slide switch, a rocker switch or a button switch.

10. The tunable long term evolution antenna according to claim 1, wherein the switch is connected to a control unit, the control unit generates a control signal to control the switch.

* * * * *